US010707566B2

(12) United States Patent
Lee

(10) Patent No.: US 10,707,566 B2
(45) Date of Patent: Jul. 7, 2020

(54) ANTENNA APPARATUS, METHOD FOR CONTROLLING THEREOF AND VEHICLE HAVING THE SAME

(71) Applicant: Hyundai Motor Company, Seoul (KR)

(72) Inventor: Byoung Hyun Lee, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 412 days.

(21) Appl. No.: 15/369,231

(22) Filed: Dec. 5, 2016

(65) Prior Publication Data

US 2017/0294708 A1 Oct. 12, 2017

(30) Foreign Application Priority Data

Apr. 8, 2016 (KR) ..... 10-2016-0043250

(51) Int. Cl.

| | |
|---|---|
| ***H01Q 1/32*** | (2006.01) |
| ***H01Q 1/48*** | (2006.01) |
| ***H01Q 9/04*** | (2006.01) |
| ***H01Q 5/50*** | (2015.01) |
| ***H01Q 5/335*** | (2015.01) |

(52) U.S. Cl.

CPC ..... *H01Q 1/3275* (2013.01); *H01Q 1/48* (2013.01); *H01Q 9/0442* (2013.01); *H01Q 1/3283* (2013.01); *H01Q 5/335* (2015.01); *H01Q 5/50* (2015.01)

(58) Field of Classification Search

CPC .. H01Q 1/1271; H01Q 1/3275; H01Q 1/1278; H01Q 1/12; H01Q 1/1207; H01Q 3/22; H01Q 15/0066; H01Q 5/335; H01Q 5/50; H01Q 9/0442; H01Q 1/3283

USPC ..... 343/713, 718, 720, 878, 906

See application file for complete search history.

(56) References Cited

U.S. PATENT DOCUMENTS

| | | | | |
|---|---|---|---|---|
| 2012/0169555 | A1* | 7/2012 | Tsou | H01Q 5/364 343/749 |
| 2013/0154888 | A1* | 6/2013 | Lin | H01Q 1/2266 343/745 |
| 2013/0203364 | A1* | 8/2013 | Darnell | H01Q 1/243 455/77 |
| 2014/0313087 | A1* | 10/2014 | Jiang | H01Q 3/22 343/745 |
| 2014/0375514 | A1* | 12/2014 | Bakalski | H01Q 5/314 343/745 |
| 2015/0380825 | A1* | 12/2015 | Ryu | H01Q 1/243 343/727 |

FOREIGN PATENT DOCUMENTS

| | | | |
|---|---|---|---|
| KR | 2006-0029601 | A | 4/2006 |
| KR | 10-0993439 | B1 | 11/2010 |
| KR | 10-2011-0126490 | A | 11/2011 |
| KR | 10-1357724 | B1 | 2/2014 |
| KR | 2014-0091757 | A | 7/2014 |
| KR | 2014-0147732 | A | 12/2014 |
| KR | 10-1516418 | B1 | 5/2015 |

* cited by examiner

*Primary Examiner* — Ricardo I Magallanes

(74) *Attorney, Agent, or Firm* — Mintz Levin Cohn Ferris Glovsky and Popeo, P.C.; Peter F. Corless

(57) ABSTRACT

An antenna apparatus includes: an antenna pattern unit receiving a radio frequency (RF) signal; a first ground unit; and a tunable switch unit electrically connecting the first ground unit to the antenna pattern unit and moving a RF signal band of an antenna when power is applied to the antenna apparatus from a power supplier.

13 Claims, 11 Drawing Sheets

ANTENNA APPARATUS, METHOD FOR CONTROLLING THEREOF AND VEHICLE HAVING THE SAME

CROSS-REFERENCE TO RELATED APPLICATION

This application claims priority to and the benefit of Korean Patent Application No. 10-2016-0043250, filed on Apr. 8, 2016 in the Korean Intellectual Property Office, the disclosure of which is incorporated herein by reference as if fully set forth herein.

BACKGROUND

1. Technical Field

Embodiments of the present disclosure relate generally to an antenna apparatus, a method for controlling thereof, and a vehicle having the same and, more particularly, to an antenna apparatus capable of moving a transmission and reception band of a RF signal using a tunable switch unit that is electrically connected to an antenna pattern unit, a method for controlling the antenna apparatus, and a vehicle having the same.

2. Description of Related Art

A vehicle antenna is generally configured to transmit and receive a radio signal to allow a broadcast or communication transceiver mounted inside of a vehicle to communicate with an external device. Meanwhile, mobile communication is commercially available, and thus a variety of devices which utilize such technology have been developed. In addition, in order to meet the diverse needs of consumers, electronic products configured to integrate various functions, such as Internet, television (TV), global positioning systems (GPS), satellite radio, digital multimedia broadcasting (DMB), telematics, and the like, have been developed and mounted in vehicles.

As the presence of these services, e.g., Internet, TV, GPS, satellite radio, DMB, telematics, etc., in vehicles increases, an antenna that operates in various frequencies, e.g., an integrated antenna configured to support a wireless communication service in a plurality of bands, may be needed.

SUMMARY

It is an aspect of the present disclosure to provide an antenna apparatus capable of moving a transmission and reception band of a radio frequency (RF) signal using a tunable switch unit that is electrically connected to an antenna pattern unit, a method for controlling the antenna apparatus, and a vehicle having the same.

Additional aspects of the present disclosure will be set forth in part in the description which follows and, in part, will be apparent from the description, or may be learned by practice of the present disclosure.

In accordance with embodiments of the present disclosure, an antenna apparatus includes: an antenna pattern unit receiving a radio frequency (RF) signal; a first ground unit; and a tunable switch unit electrically connecting the first ground unit to the antenna pattern unit and moving a RF signal band of an antenna when power is applied to the antenna apparatus from a power supplier.

The tunable switch unit may include a power distributor provided with at least two resistances, and the power distributor may distribute the power applied to the antenna apparatus from the power supplier corresponding to a resistance of the at least two resistances.

The tunable switch unit further may include a controller controlling the first ground unit and the antenna pattern unit to be connected to each other or disconnected from each other according to whether the power is applied to the antenna apparatus from the power supplier.

The controller may control the first ground unit and the antenna pattern unit to be connected to each other when the power is applied to the antenna apparatus from the power supplier and the power is distributed via the power distributor.

The controller may control the first ground unit and the antenna pattern unit to be disconnected from each other when the power is not applied to the antenna apparatus from the power supplier and the power is not distributed via the power distributor.

The first ground unit may include at least one of a variable inductor and a variable capacitor.

The power applied to the antenna apparatus from the power supplier may be 3 volts or a predetermined voltage.

A matching unit may matching an impedance of the antenna.

A second ground unit different from the first ground unit may be connected to the antenna pattern unit.

Furthermore, in accordance with embodiments of the present disclosure, a method for controlling an antenna apparatus includes: receiving, at a tunable switch unit, power supplied from a power supplier; distributing, by a power distributor, the supplied power to a controller; and moving, by the tunable switch unit, a radio frequency (RF) signal band of an antenna by connecting a first ground unit and an antenna pattern unit to each other when the power is distributed to the controller.

The receiving of power at the tunable switch may include receiving 3 volts or a predetermined voltage.

The first ground unit may include at least one of a variable inductor and a variable capacitor.

Furthermore, in accordance with embodiments of the present disclosure, a vehicle includes: a power supplier; and an antenna apparatus including an antenna pattern unit receiving a radio frequency (RF) signal, a first ground unit, and a tunable switch unit electrically connecting the first ground unit to the antenna pattern unit and moving a RF signal band of an antenna when power is applied to the antenna apparatus from the power supplier.

The tunable switch unit may include a power distributor provided with at least two resistances, and the power distributor distributes the power applied to the antenna apparatus from the power supplier corresponding to a resistance of the at least two resistances.

The tunable switch unit may include a controller controlling the first ground unit and the antenna pattern unit to be connected to each other or disconnected from each other according to whether the power is applied to the antenna apparatus from the power supplier.

The controller may control the first ground unit and the antenna pattern unit to be connected to each other when the power is applied to the antenna apparatus from the power supplier and the power is distributed via the power distributor.

The controller may control the first ground unit and the antenna pattern unit to be disconnected from each other when the power is not applied to the antenna apparatus from the power supplier and the power is not distributed via the power distributor.

The first ground unit may include at least one of a variable inductor and a variable capacitor.

The power applied to the antenna apparatus from the power supplier may be 3 volts or a predetermined voltage.

A feeder cable may connect the antenna apparatus to the power supplier.

BRIEF DESCRIPTION OF THE DRAWINGS

These and/or other aspects of the disclosure will become apparent and more readily appreciated from the following description of embodiments, taken in conjunction with the accompanying drawings of which.

Figure 1:
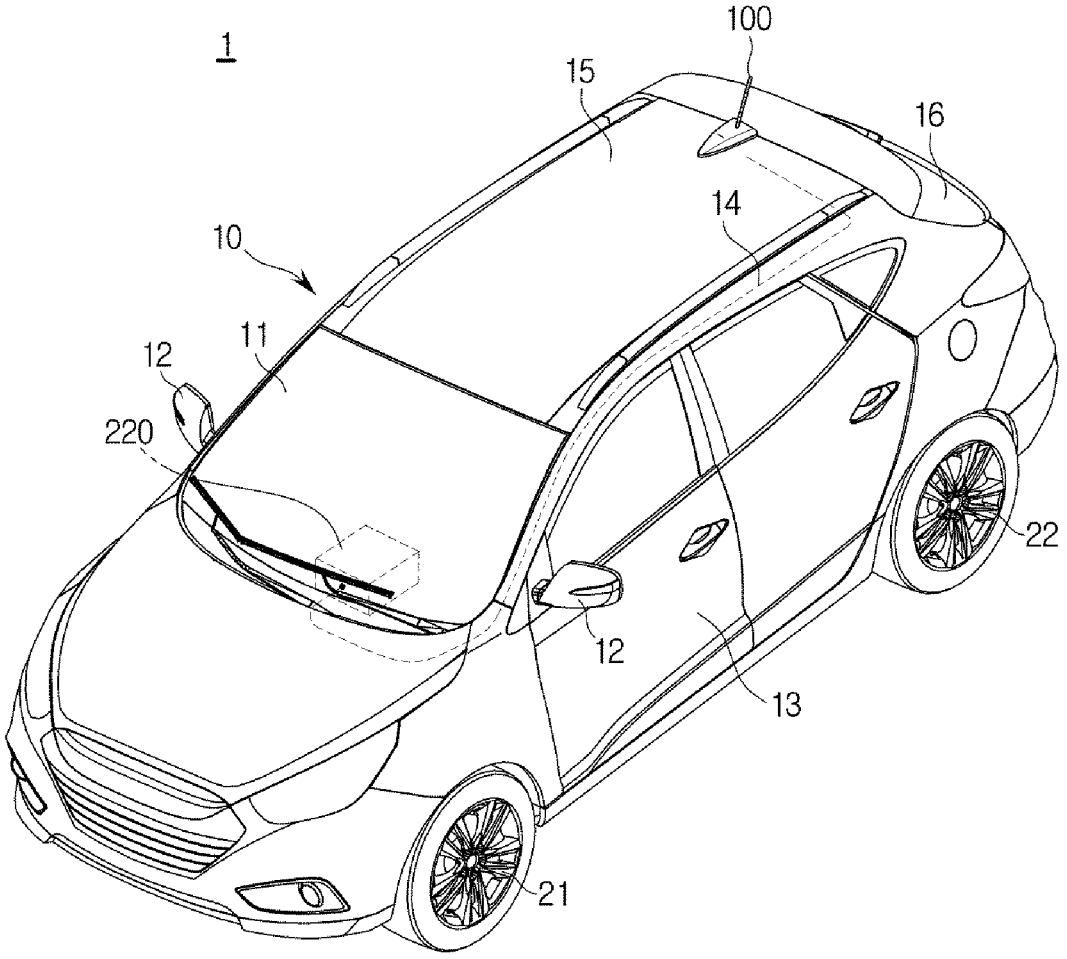
FIG. 1 is a view illustrating an exterior of a vehicle in accordance with embodiments of the present disclosure.

It should be understood that the above-referenced drawings are not necessarily to scale, presenting a somewhat simplified representation of various preferred features illustrative of the basic principles of the disclosure. The specific design features of the present disclosure, including, for example, specific dimensions, orientations, locations, and shapes, will be determined in part by the particular intended application and use environment.

DETAILED DESCRIPTION OF THE EMBODIMENTS

The present disclosure will be described more fully hereinafter with reference to the accompanying drawings, in which exemplary embodiments of the disclosure are shown. As those skilled in the art would realize, the described embodiments may be modified in various different ways, all without departing from the spirit or scope of the present disclosure. Further, throughout the specification, like reference numerals refer to like elements.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Additionally, it is understood that one or more of the below methods, or aspects thereof, may be executed by at least one controller. The term "controller" may refer to a hardware device that includes a memory and a processor. The memory is configured to store program instructions, and the processor is specifically programmed to execute the program instructions to perform one or more processes which are described further below. Moreover, it is understood that the below methods may be executed by an apparatus comprising the controller in conjunction with one or more other components, as would be appreciated by a person of ordinary skill in the art.

Furthermore, the controller of the present disclosure may be embodied as non-transitory computer readable media containing executable program instructions executed by a processor, controller or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed throughout a computer network so that the program instructions are stored and executed in a distributed fashion, e.g., by a telematics server or a Controller Area Network (CAN).

Hereinafter an antenna apparatus, a method for controlling the antenna apparatus, and a vehicle having the antenna apparatus will be described with reference to FIGS. 1 to 10.

Figure 2:
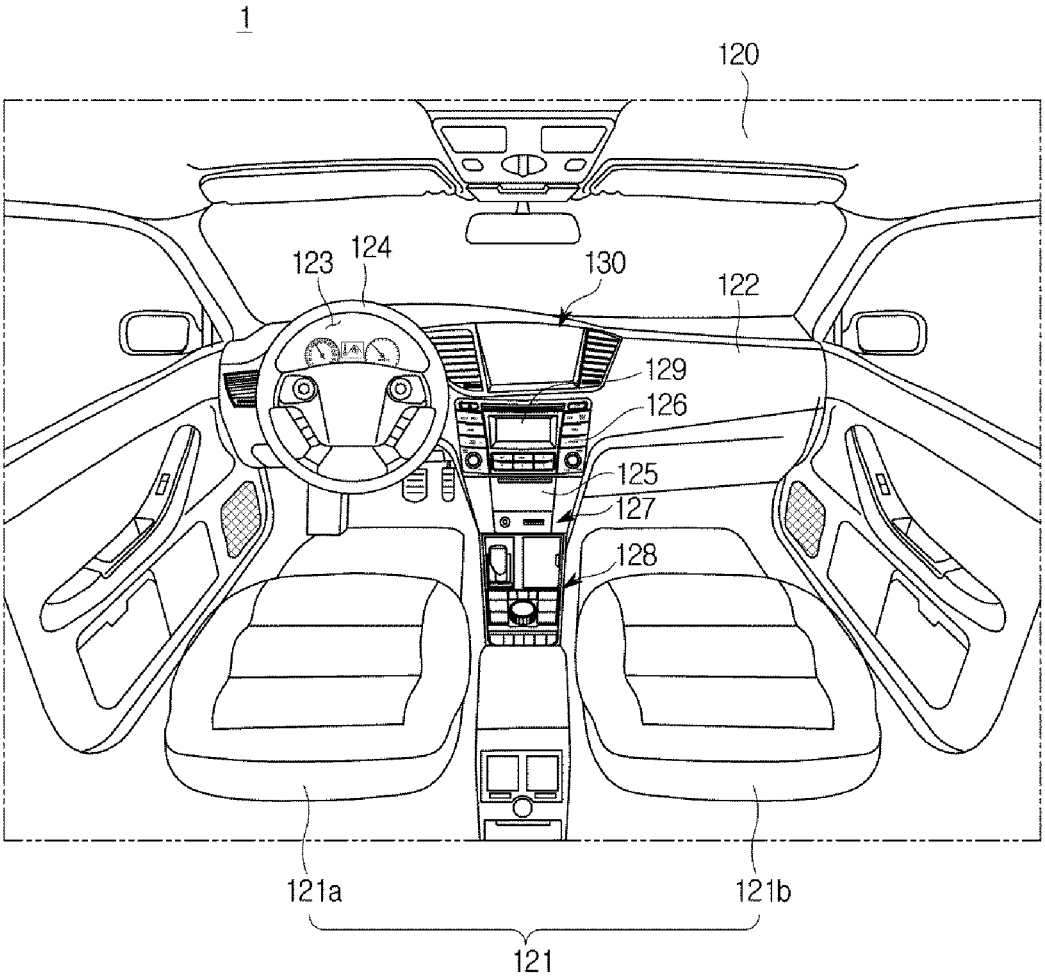
FIG. 2 is a view illustrating an interior of a vehicle in accordance with embodiments of the present disclosure.

FIG. 1 is a view illustrating an exterior of a vehicle in accordance with embodiments of the present disclosure and FIG. 2 is a view illustrating an interior of a vehicle in accordance with embodiments of the present disclosure.

Referring first to FIG. 1, a vehicle 1 may include a body 10 forming an exterior of the vehicle 1, a windscreen 11 providing a front view of the vehicle 1 to a driver, a side mirror 12 providing a rear view of the vehicle 1 to a driver, a door 13 closing the inside of the vehicle 1 from the outside, a front wheel 21 provided in the front side of the vehicle, and a rear wheel 22 provided in the rear side of the vehicle, wherein the front wheel 21 and the rear wheel 22 may be totally referred to as a vehicle wheel.

The windscreen 11 may be provided on an upper portion of the front of the body 10 to allow a driver inside the vehicle 1 to acquire visual information about the front of the vehicle 1. The side mirror 12 may include a left side mirror provided on the left side of the body 10 and a right side mirror provided on the right side of the body 10, and may allow a driver inside the vehicle 1 to acquire visual information of the lateral side and the rear side of the vehicle 1.

The door 13 may be rotatably provided on a right side and a left side of the body 10. When the door 13 is opened, a driver may be allowed to be seated in the vehicle 1, and when the door 13 is closed, the inside of the vehicle 1 may be closed from the outside.

The vehicle 1 may be further include an antenna apparatus 100 provided in a roof panel, and configured to receive a radio signal, a broadcast signal and a satellite signal, and transmit and receive a signal to and from another vehicle, Intelligence Transportation System (ITS) server and a base station.

The antenna apparatus 100 may be mounted to the exterior of the vehicle 1.

Particularly, since the antenna apparatus 100 is implemented to be compact and a low position, the antenna apparatus 100 may be mounted on the roof panel 15, and a front panel, but is not limited thereto.

The antenna apparatus 100 may be integrally implemented with a hot wire in a rear side of the roof panel 15 particularly, in an upper side of a rear window glass 16. In addition, when the antenna apparatus 100 is installed in the roof panel 15, the antenna apparatus 100 may be a micro pole type antenna or a shark fin type antenna. However, an antenna illustrated in FIG. 1 is an example of an exterior of micro pole antenna.

The antenna apparatus 100 may be connected to an Audio/Video/Navigation (AVN) device 130 provided in the inside of the vehicle 1, and configured to provide an audio function, a video function, and a TV function as well as route guide information according to user's operation command. In addition, the antenna apparatus 100 may transmit and receive a variety of signal to and from a controller 220 configured to perform an overall control of the vehicle 1. The signal may be transmitted and received via a feeder cable 14 configured to connect the controller 220 to the antenna apparatus 100. In addition, the antenna apparatus 100 may receive a power from a power supplier 240 according to a power supply control command that is received from the controller 220. Supplying power from the power supplier 240 to the antenna apparatus 100 may be stopped according to a power stop control command that is received from the controller 220. A detail description thereof will be described later.

The above mentioned antenna apparatus 100 may receive at least one of Radio frequency (RF) signal, AM/FM signal, DBM signal, LTE/3G signal, GPS signal, SXM signal, DAB signal, eCall signal, GNSS signal, and Baidu signal.

It should be understood that the exterior vehicle configuration depicted in FIG. 1 and described above is provided merely for demonstration purposes and does not limit the scope of the present disclosure. Rather, the exterior of the vehicle 1 may be modified in any suitable manner, as would be understood by a person of ordinary skill in the art, in accordance with the present claims.

Referring next to FIG. 2, the interior 120 of the body may include a seat 121; 121*a* and 121*b* on which a passenger is seated, a dashboard 122, an instrument panel 123, i.e. a cluster, a steering wheel 124 to change the direction of the vehicle, and a center fascia 125 in which an operation panel of an audio device and an air conditioning device is installed, wherein the instrument panel may be disposed on the dashboard and may include tachometer, speedometer, coolant temperature indicator, fuel indicator, turn signal indicator, high beam indicator light, warning light, seat belt warning light, trip odometer, odometer, automatic transmission selector lever indicator, door open warning light, oil warning light, and a low fuel warning light.

The seat 121 may include a driver seat 121*a* on which a driver is seated, a passenger seat 121*b* on which a passenger is seated, and a rear seat provided in the rear side of the inside of the vehicle.

The cluster 123 may be implemented in a digital manner. The cluster 123 in the digital manner may display vehicle information and driving information as an image.

The center fascia 125 may be disposed between the driver seat 121*a* and the passenger seat 121*b* on the dashboard 122, and may include a head unit 126 configured to control the audio device, the air conditioning device and a hot-wire in the seat.

The head unit 126 may include a plurality of buttons to receive an input of an operation command for the audio device, the air conditioning device, and the hot-wire in the seat.

In the center fascia 125, an air outlet, a cigar jack, and a multi-terminal 127 may be installed.

The multi-terminal 127 may be disposed adjacent to the head unit 126, and may include a USB port, an AUX terminal, and further include a SD slot.

The vehicle 1 may further include an input 128 configured to receive an operation command of a variety of functions, and a display unit 129 configured to display information related to a function currently performed, and information input by a user.

The input 128 may be disposed on the head unit 126 and the center fascia 125, and may include at least one physical button such as On/Off button for operation of the variety of functions, and a button to change a set value of the variety of functions.

The input 128 may transmit an operation signal of the button to an Electronic Control Unit (ECU) and the controller 220 in the head unit 126 or the AVN device 130.

The input 128 may include a touch panel integrally formed with the display of the AVN device 130. The input 128 may be activated and displayed as the shape of the button on the display of the AVN device 130, and may receive an input of the location information of the button displayed.

The input 128 may further include a jog dial (not shown) or a touch pad to input a command for moving cursor and selecting cursor, wherein the cursor is displayed on the display of the AVN device 130. The jog dial or touch pad may be provided in the center fascia.

Particularly, the input 128 may be capable of receiving any one of input of a manual driving mode, in which a driver directly drives a vehicle, and an autonomous driving mode, and may transmit an input signal of the autonomous driving mode to the ECU when the autonomous driving mode is input.

When a navigation function is selected, the input 128 may receive an input of information related to the destination, transmit the input information related to the destination to the AVN device 130, and when a DMB function is selected, the input 128 may receive an input of information related to the channel and sound volume, and transmit the input information related to the channel and sound volume to the AVN device 130.

The AVN device 130 configured to receive information from a user and configured to output a result corresponding to the input information may be provided in the center fascia 125.

The AVN device 130 may perform at least one function of a navigation function, a DMB function, an audio function, and a video function, and may display information related to the road condition and the driving during the autonomous driving mode.

The AVN device 130 may be installed on the dash board to be vertically stood.

The chassis of the vehicle may further include a power system, a power train, a steering system, a brake system, a suspension system, a transmission device, a fuel system and front, rear, left and right vehicle wheels. The vehicle may further include a variety of safety devices for a driver and passenger safe.

The safety devices of the vehicle may include a variety of safety devices, such as an air bag control device for the safety of the driver and passenger when the collision of the vehicle, and an Electronic Stability Control (ESC) configured to maintain the stability of the vehicle when accelerating or cornering.

The vehicle 1 may further include a detection device, e.g., a proximity sensor configured to detect an obstacle or another vehicle placed in the rear side or the lateral side of the vehicle; a rain sensor configured to detect whether to rain or an amount of rain; a wheel speed sensor configured to detect the wheel of the vehicle; a lateral acceleration sensor configured to detect a lateral acceleration of the vehicle; a yaw rate sensor and a gyro sensor configured to detect the variation of angular speed of the vehicle; and a steering angle sensor configured to detect a rotation of a steering wheel of the vehicle.

The vehicle 1 may include an Electronic Control Unit (ECU) configured to control an operation of the power system, the power train, the driving device, the steering system, the brake system, the suspension system, the transmission device, the fuel system, the variety of safety devices, and the variety of sensors. A detail description of an electronic device will be described later with reference to FIG. 3.

The vehicle 1 may selectively include an electronic device such as a hand-free device, a GPS, an audio device, a bluetooth device, a rear camera, a device for charging terminal device, and a high-pass device, which are installed for the convenience of the driver.

The vehicle 1 may further include an ignition button configured to input an operation command to an ignition motor (not shown).

That is, when the ignition button is turned on, the vehicle 1 may turn on an ignition motor (not shown) and drive an engine (not shown) that is the power generation device, trough the operation of the ignition motor.

The vehicle 1 may further include a battery (not shown) configured to supply a driving power by being electrically connected to a terminal device, an audio device, an interior lamp, an ignition motor and other electronic device. The battery may perform a charging by using a generator itself or a power from an engine, while the vehicle drives.

It should be understood that the interior vehicle configuration depicted in FIG. 2 and described above is provided merely for demonstration purposes and does not limit the scope of the present disclosure. Rather, the interior of the vehicle 1 may be modified in any suitable manner, as would be understood by a person of ordinary skill in the art, in accordance with the present claims.

Figure 3:
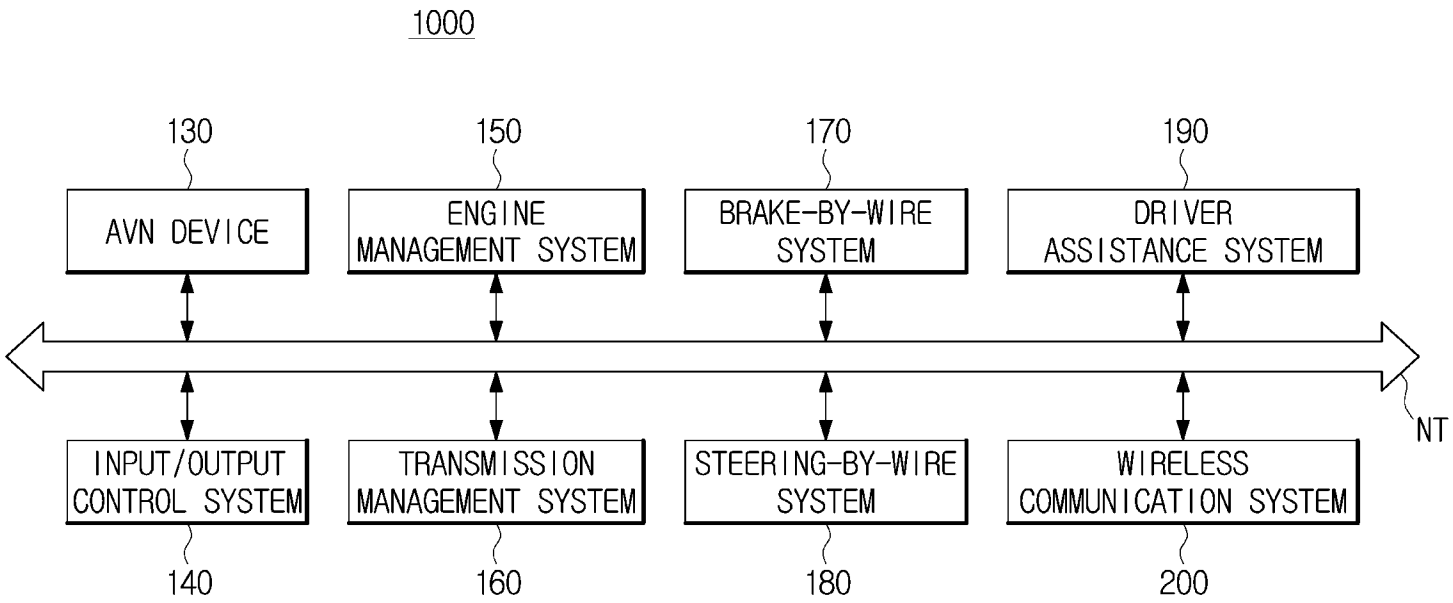
FIG. 3 is a view illustrating an electronic device included in a vehicle in accordance with embodiments of the present disclosure.

FIG. 3 is a view illustrating an electronic device included in a vehicle in accordance with embodiments of the present disclosure.

The vehicle 1 may include a power system (not shown) configured to generate a power to move the vehicle 1; a power train (not shown) configured to transmit the power generated in the power system (not shown) to the vehicle wheel; a steering system (not shown) configured to control a moving direction of the vehicle 1; a brake system (not shown) configured to stop a rotation of the vehicle wheel; a suspension system (not shown) configured to reduce a vibration of the vehicle 1; and an electric device 1000 configured to electrically control each component included in the vehicle 1.

The power system may include an engine, a fuel device, a cooling device, an exhaust system, and an ignition system, and the power train may include a clutch, a transmission, a differential device gear and a drive shaft.

The steering system may include a steering wheel; a steering gear; and a steering link. The brake system may include a brake disk; a brake pad; and a master cylinder. The suspension system may include a shock absorber.

The vehicle 1 may include the electric device 1000 as well as the above mentioned mechanical devices.

Particularly, as illustrated in FIG. 3, the vehicle 1 may include the AVN device 130; an input/output control system 140; an engine management system (EMS) 150; a Transmission Management System (TMS) 160; a brake-by-wire system 170; a steering-by-wire system 180; a driver assistance system (DAS) 190; and a wireless communication system 200. The electric device 1000 illustrated in FIG. 3 are a part of the electric device included in the vehicle 1, and thus more various electric devices may be installed in the vehicle 1. In addition, the vehicle 1 may not include all of the electric devices 1000 illustrated in FIG. 3, and thus some of the electric device 1000 may be omitted.

A variety of the electric device 1000 included in the vehicle 1 may communicate with each other via a vehicle communication network (NT). The vehicle communication network (NT) may employ a communication standard, e.g., Media Oriented Systems Transport (MOST) having a maximum communication speed of 24.5 (Mega-bits per second) Mbps, FlexRay having a maximum communication speed of 10 Mbps, Controller Area Network (CAN) having a communication speed of 125 (kilo-bits per second) kbps to 1 Mbps, and Local Interconnect Network (LIN) having a communication speed of 20 kbps. The vehicle communication network (NT) may employ a single communication standard, e.g., MOST, FlexRay, CAN, and LIN, but also may employ a plurality of communication standards.

The AVN device 130 may be a kind of apparatus configured to output music or an image in response to a user's control command. Particularly, the AVN device 130 may play music or a video or guide a route to a destination in response to a user's control command.

The input/output control system 140 may receive a user's control command via a button, and display information corresponding to the user's control command. The input/output control system 140 may include a cluster display disposed on the dash board and configured to display a vehicle speed, a RPM, and an amount of lubrication, and a wheel button module installed in the steering wheel.

The engine management system (EMS) 150 may perform a fuel injection control, an air-fuel ratio feedback control, lean combustion control, an ignition timing control and an idling speed control. The engine control system 150 may not only be a single device, but also a plurality of devices connected to each other via a communication.

The Transmission Management System (TMS) 160 may perform a shift point control, a damper clutch control, a pressure control when a friction clutch is turned on/off and an engine torque control during shifting. The Transmission Management System (TMS) 160 may not only be a single device, but also a plurality of devices connected to each other via a communication.

The brake-by-wire system 170 may control braking of the vehicle 1, and may include Anti-lock Brake System (ABS).

The steering-by-wire system 180 may assist a driver's steering operation by reducing a steering force during driving at a low-speed or parking, and by increasing the steering force during driving at high-speed.

The driver assistance system (DAS) 190 may assist the driving of the vehicle 1 and may perform a forward collision avoidance function, a lane departure warning function, a blind spot detection function, and a rear detection function.

The driver assistance system (DAS) 190 may include a plurality of devices that is connected via a communication. For example, the driver assistance system (DAS) 190 may include Forward Collision Warning System (FCW), Advanced Emergency Braking System (AEBS), Adaptive Cruise Control (ACC), Lane Departure Warning System (LDWS), Lane Keeping Assist System (LKAS), Blind Spot Detection (BSD) and Rear-end Collision Warning System (RCW).

The wireless communication system 200 may communicate with an external vehicle, an external terminal or a communication relay device.

The wireless communication system 200 may transmit and receive a signal by using a variety of communication protocols. For example, the wireless communication system 200 may employ 2G communication method, e. g. Time Division Multiple Access (TDMA) and Code Division Multiple Access (CDMA), 3G communication method, e. g. Wide Code Division Multiple Access (WCDMA), Code Division Multiple Access (CDMA) 2000, Wireless Broadband (Wibro), and World Interoperability for Microwave Access (WiMAX), and 4G communication method, e. g. Long Term Evolution (LTE) and Wireless Broadband Evolution. In addition, the wireless communication system 200 may employ 5G communication method. The wireless communication system 200 may include an internal communication unit 210 and a wireless communication unit 230. A detail description of the internal communication unit 210 and the wireless communication unit 230 will be described with reference to FIG. 4.

Figure 4:
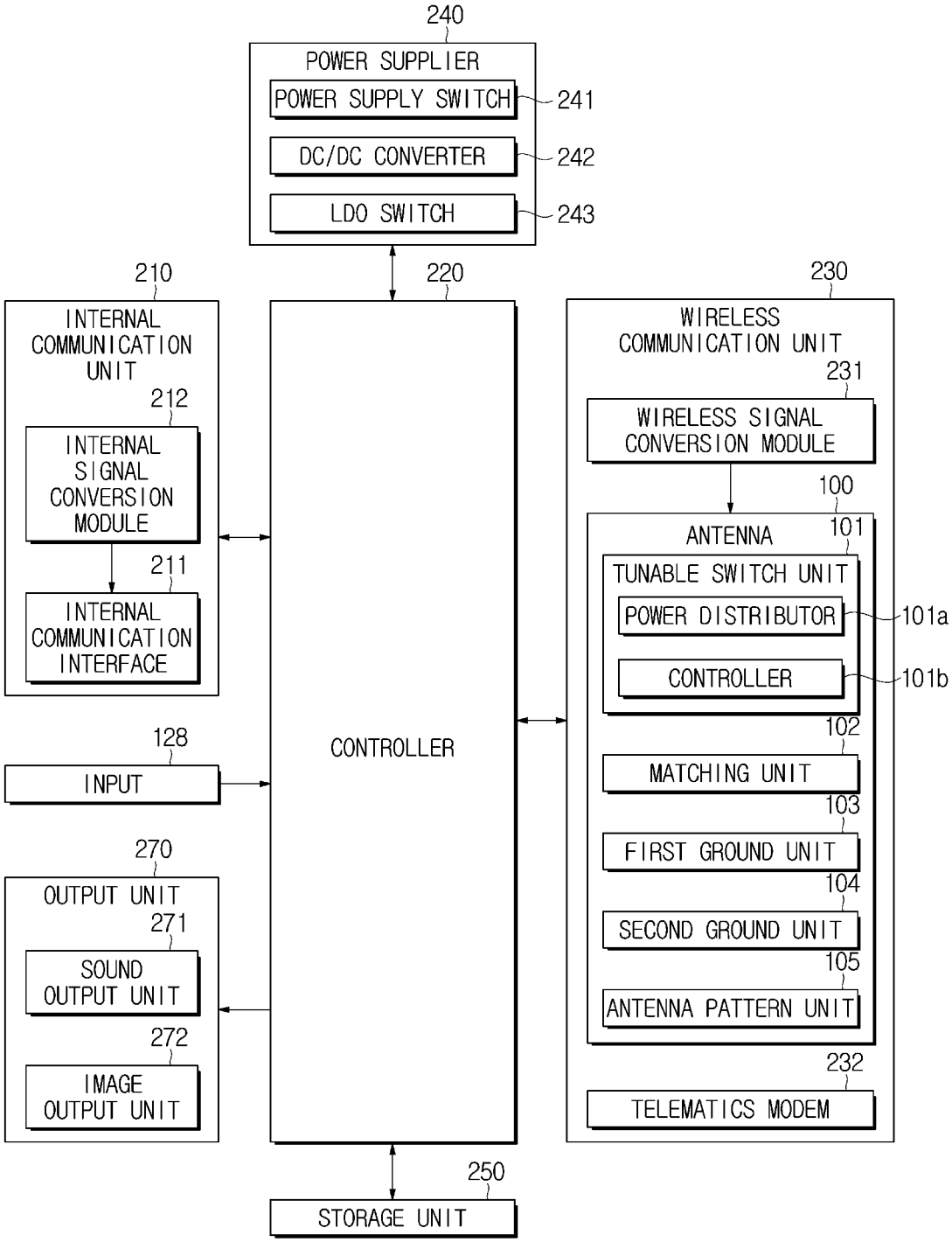
FIG. 4 is a block diagram illustrating a configuration of a vehicle in accordance with embodiments of the present disclosure.

FIG. 4 is a block diagram illustrating a configuration of a vehicle in accordance with embodiments of the present disclosure.

The vehicle 1 may include an input 128; an internal communication unit 210; a controller 220; a wireless communication unit 230; a power supplier 240; a storage unit 250; and an output unit 270. In addition, the vehicle 1 may further include a feeder cable 14 configured to connect the antenna apparatus 100 of the wireless communication unit 230 to the power supplier 240.

Through the input 128, a user may input a command configured to control the plurality of the electric device 1000 included in the vehicle 1 or input a command configured to control a component included in the vehicle 1. A description of the input 128 is described in FIG. 2, and thus it will be omitted.

The internal communication unit 210 may communicate with the plurality of the electric devices 1000 inside of the vehicle 1 via a vehicle communication network inside of the vehicle 1. In addition, the internal communication unit 210 may include an internal communication interface 211 connected to the vehicle communication network and an internal signal conversion module 212 configured to modulate and demodulate a signal.

The internal communication interface 211 may receive a communication signal that is transmitted from the plurality of the electric devices 1000 inside of the vehicle 1 via the vehicle communication network, and transmit a communication signal to the plurality of the electric devices 1000 inside of the vehicle 1 via the vehicle communication network. The communication signal may represent a signal configured to be transmitted and received via the vehicle communication network.

The internal communication interface 211 may include a communication port and a transceiver configured to transmit and receive a signal.

The internal signal conversion module 212 may demodulate a communication signal that is received via the internal communication interface 211 into a control signal according to a control of the controller 220 that is described in the following, and modulate a control signal output from the controller 220 into an analog communication signal, which is then transmitted via the internal communication interface 211.

The internal signal conversion module 212 may modulate a control signal output from the controller 220 into a communication signal in accordance with a communication protocol of the vehicle network, and demodulate a communication signal in accordance with a communication protocol of the vehicle network into a control signal that is recognizable by the controller 220.

The internal signal conversion module 212 may include a memory in which programs and data to perform modulation and demodulation of the communication signal are stored, and a processor configured to perform the modulation and the demodulation of the communication signal according to the program and data stored in the memory.

The controller 220 may control an operation of the internal signal conversion module 212 and the internal communication interface 211. For example, when transmitting a communication signal, the controller 220 may determine whether the communication network is occupied by another electronic device, via the internal communication interface 211 and when the communication network is not occupied, the controller 220 may control the internal communication interface 211 and the internal signal conversion module 212 to transmit the communication signal. In addition, when receiving the communication signal, the controller 220 may control the internal communication interface 211 and the internal signal conversion module 212 to demodulate the communication signal received via the internal communication interface 211.

The controller 220 may include a memory in which programs and data to control the internal signal conversion module 212 and the internal communication interface 211 are stored, and a processor configured to generate a control signal according to the program and data stored in the memory.

The wireless communication unit 230 may include a wireless signal conversion module 231 configured to modulate and demodulate a signal, an antenna apparatus 100 configured to transmit a modulated signal to the outside and configured to receive a signal from the outside, and a telematics modem 232.

The wireless signal conversion module 231 may demodulate a radio signal received via the antenna apparatus 100, and modulate a control signal output from the controller 220 into a radio signal which is then transmitted to the outside.

The wireless signal conversion module 231 may include a memory in which programs and data to perform modulation and demodulation of the communication signal are stored, and a processor configured to perform the modulation and the demodulation of the communication signal according to the program and data stored in the memory.

The antenna apparatus 100 may receive an external signal or transmit a signal to an external vehicle or an external device. The signal may include at least one of RF signal, AM/FM signal, DBM signal, LTE/3G signal, GPS signal, SXM signal, DAB signal, eCall signal, GNSS signal, and Baidu signal.

The antenna apparatus 100 may be configured to transmit and receive a RF signal, wherein the RF signal band may include 500 MHz to 1500 MHz. However, the bandwidth is an example and the antenna apparatus 100 may have a wider RF signal band.

The antenna apparatus 100 may move the RF signal band by using a tunable switch unit 101. In other words, the antenna apparatus 100 may move a resonant frequency of the antenna apparatus 100. For example, when it is assumed that a RF signal transmission and reception band of the antenna apparatus 100 currently has a resonant frequency of 920 MHz, and a bandwidth is from 700 MHz to 1200 MHz, the antenna apparatus 100 may move the RF signal band to a RF signal band in which a resonant frequency is 730 MHz, and a bandwidth is from 620 MHz to 900 MHz, but is not limited thereto. A detail description of the movement of the RF signal band of the antenna apparatus 100 will be described later with reference to FIGS. 5 to 7.

The antenna apparatus 100 may include a tunable switch unit 101, a matching unit 102, a first ground unit 103, and an antenna pattern unit 105. In addition, the antenna apparatus 100 may further include a second ground unit 104 that is different from the first ground unit 103.

The tunable switch unit 101 may be configured to move a RF signal band of the antenna apparatus 100 by changing an electrical length of the antenna apparatus 100 according to the need of each band among a plurality of bands of RF signal. In addition, the tunable switch unit 101 may receive the power from the power supplier 240 according to the power supply command of the controller 220. The power supplied from the power supplier 240 may be 3 volts or a predetermined voltage.

The tunable switch unit 101 may include a power distributor 101*a* and a controller 101*b*. The power distributor 101*a* may include at least two resistances. When receiving the power form the power supplier 240, the power distributor 101*a* may distribute the applied power to correspond to the resistance, and the distributed power may be applied to the controller 101*b*. As mentioned above, in this case, the power may be 3 volts or a predetermined voltage, or the power may be distributed according to the voltage distribution law by a resistance.

According to whether the power is applied from the power distributor 240, the controller 101*b* may control the first ground unit 103 and the antenna pattern unit 105 so that the first ground unit 103 and the antenna pattern unit 105 are connected to each other or the first ground unit 103 and the antenna pattern unit 105 are maintained to be disconnected from each other.

Particularly, when the power is applied from the power supplier 240 and then the power is distributed by the power distributor 101*a*, the controller 101*b* may control the first ground unit 103 and the antenna pattern unit 105 so that the first ground unit 103 and the antenna pattern unit 105 are connected to each other. This is to allow a ground point of the antenna pattern unit 105 to be changed so as to move the RF signal band of the antenna apparatus 100 by changing an electrical length of the antenna.

In general, the RF signal transmission and reception band of the antenna apparatus 100 may vary according to a physical length of the antenna, and thus a physical length of the antenna may be needed to be long to transmit and receive a RF signal having a low frequency, and a physical length of the antenna may be needed to be short to transmit and receive a RF signal having a high frequency. However, adjusting the physical length may be inappropriate for the antenna apparatus 100 that is needed to be compact. Therefore, rather than adjusting the physical length, adjusting the electrical length of the antenna apparatus 100 may be more efficient by changing a ground point of the antenna pattern unit 105 by using the tunable switch unit 101.

As mentioned above, by using a single antenna apparatus 100, the RF signal band of the antenna apparatus 100 may be moved through the tunable switch unit 101 according to the need of the RF signal band of the antenna apparatus 100. Accordingly, the antenna apparatus 100 may have various and wide RF signal bands.

When the power is not applied from the power supplier 240 and then the power is not distributed by the power distributor 101*a*, the first ground unit 103 and the antenna pattern unit 105 may be maintained to be disconnected from each other. In this case, the electrical length of the antenna apparatus 100 may be not changed so that the movement of the RF signal band is not performed.

The matching unit 102 may be electrically connected to the antenna pattern unit 105 and include at least one of a variable inductor and a variable capacitor, respectively. Accordingly, the matching unit 102 may match an impedance of the antenna and an impedance of a previous stage of the antenna.

The first ground unit 103 may include at least one of a variable inductor and a variable capacitor, and may be electrically connected to the tunable switch unit 101. Particularly, the first ground unit 103 may be connected to the tunable switch unit 101 or be disconnected from the tunable switch unit 101 according to whether the power is applied to the tunable switch unit 101 by the power supplier 240.

The second ground unit 104 may be a ground unit that is different from the first ground unit 103, and unlike the case of the first ground unit 103, the second ground unit 104 may be directly connected to the antenna pattern unit 105 without being connected to the tunable switch unit 101. The type of the antenna apparatus 100 may vary according to the presence of the connection of the first ground unit 103 and the presence of the connection of the second ground unit 104, and a detail description thereof will be described later with reference to FIGS. 8 and 9.

The antenna pattern unit 105 may be conductive material and electrically connected to the matching unit 102 and the tunable switch unit 101. In addition, the antenna pattern unit 105 may receive a RF signal. According to the type of the antenna apparatus 100, the antenna pattern unit 105 may be electrically connected to the second ground unit 104 or disconnected from the second ground unit 104.

The telematics modem 232 may transmit and receive a variety of information by transmitting and receiving a signal to and from an external device or an external telematics server via the wireless communication unit 230 of the vehicle 1.

The telematics modem 232 may receive a variety of information, e. g. traffic and driving information, emergency response information, vehicle remote diagnostics service, and Internet by using a wireless communication system and Global Positioning System (GPS). The telematics modem 232 may transmit information related to car accident and information stored in the vehicle to an external vehicle, an external device and a telematics server.

When receiving a signal related to a power application command in an electrical manner, from the controller 220, the power supplier 240 may supply the power to each component. In addition, the power supplier 240 may directly apply the power to each component inside of the vehicle 1 without passing through the controller 220.

The power supplier 240 may supply the power to the tunable switch unit 101 of the antenna apparatus 100 in response to the power supply control command of the controller 220.

The power may be defined as "VDD power", and the power may be 3 volts or a predetermined voltage. When the power is applied to the tunable switch unit 101 of the antenna apparatus 100 via the power supplier 240, the tunable switch unit 101 may be activated to connect the antenna pattern unit 105 to the first ground unit 103. When the antenna pattern unit 105 and the first ground unit 103 are connected to each other, a ground point of the antenna pattern unit 105 may be changed and thus the electrical length of the antenna apparatus 100 may be changed. In accordance with the change, the RF signal band of the antenna apparatus 100 may be moved.

The power supplier 240 may not apply the power to the tunable switch unit 101 of the antenna apparatus 100 in response to the power stop control command of the controller 220. When the power is not applied to the tunable switch unit 101, the power may be not distributed to the controller 101*b* via the power distributor 101*a* so that the first ground unit 103 and the antenna pattern unit 105 are disconnected from each other. In this case, since the first ground unit 103 is not connected to the antenna pattern unit 105, the electrical length of the antenna apparatus 100 may be not changed and thus the RF signal band may be not moved.

The power supplier 240 may include a power supply switch 241; a DC/DC converter 242; and a low drop out (LDO) switch 243.

The power supply switch 241 may control the power supplier 240 in response to the power supply or stop control command of the controller 220 so that the power supplier 240 supplies the power to the tunable switch unit 101 or does not supply the power to the tunable switch unit 101.

The DC/DC converter 242 may convert a high voltage direct current (DC), which is from a high voltage battery, into a low voltage DC and then supply DC power to the tunable switch unit 101 of the antenna apparatus 100 in response to the power supply control command of the controller 220.

The LDO switch 243 may reduce the power applied to the tunable switch unit 101 from the power supplier 240. For example, when it is assumed that a voltage output from the power supplier 240 is 3 volts, the LDO switch 243 may reduce 3 volts voltage into 2 volts and then allow 2 volts to be applied to the tunable switch unit 101.

The storage unit 250 may store programs for the process and the control of the controller 220, or temporarily store data that is input or output. In addition, the storage unit 250 may store setting information related to the electric device 1000 of the vehicle 1 and update information related to software about the control of the vehicle 1.

The storage unit 250 may include a store medium in at least one type of flash memory type, hard disk type, multimedia card micro type, card memory type (e. g, SD or XD memory), Random Access Memory (RAM), Static Random Access Memory (SRAM), Read-Only Memory (ROM), Electrically Erasable Programmable Read-Only Memory (EEPROM), (Programmable Read-Only Memory (PROM), magnetic memory, magnetic disk, optical disk, and the like.

The output unit 270 may include a sound output unit 271 and an image output unit 272. The sound output unit 271 may output sound information to a user by using a speaker provided inside of the vehicle. In addition, the image output unit 272 may output image information to a user by using the AVN device 130 and other displays.

Figure 5:
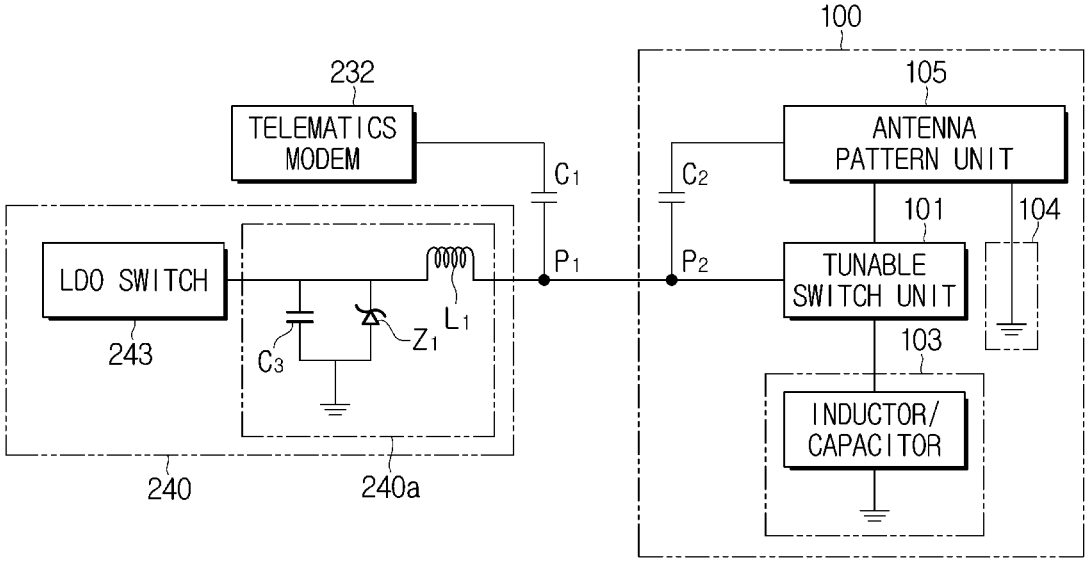
FIG. 5 is a view illustrating of supplying power by using a phantom feeding method in accordance with embodiments of the present disclosure.

FIG. 5 is a view illustrating of supplying power by using a phantom feeding method in accordance with embodiments of the present disclosure.

As shown in FIG. 5, a detail description about applying power by using the phantom feeding method of the power supplier 240 will be described through a relationship among the telematics modem 232, the power supplier 240 and the antenna apparatus 100. However, a description of the same part as shown in the above will be omitted.

The power supplier 240 may apply the power to the antenna apparatus 100 in the phantom feeding method in response to the power apply command of the controller 220. The phantom feeding method may represent a method to allow a power to be supplied to only the tunable switch unit 101 while preventing the power from being supplied to the telematics modem 232 and the antenna pattern unit 105, when DC power is supplied from the power supplier 240 to the feeder cable 14 between P1 and P2.

Particularly, in the case of DC power, supplying power to the telematics modem 232 may be stopped by a first capacitor (C1), and also supplying power to the antenna pattern unit 105 may be stopped by a second capacitor (C2). Therefore, the power supplied from the power supplier 240 may be applied to the tunable switch unit 101 without change.

The power supplier 240 may include the LDO switch 243 wherein the LDO switch 243 may reduce the supplied power, as mentioned above.

The power supplier 240 may include a power supply stabilization circuit 240*a*. The power supply stabilization circuit 240*a* may include a first inductor (L1), a third capacitor (C3) and a zener diode (Z1). The power supply stabilization circuit 240*a* may stably maintain the supplied power by the zener diode (Z1).

Figure 6:
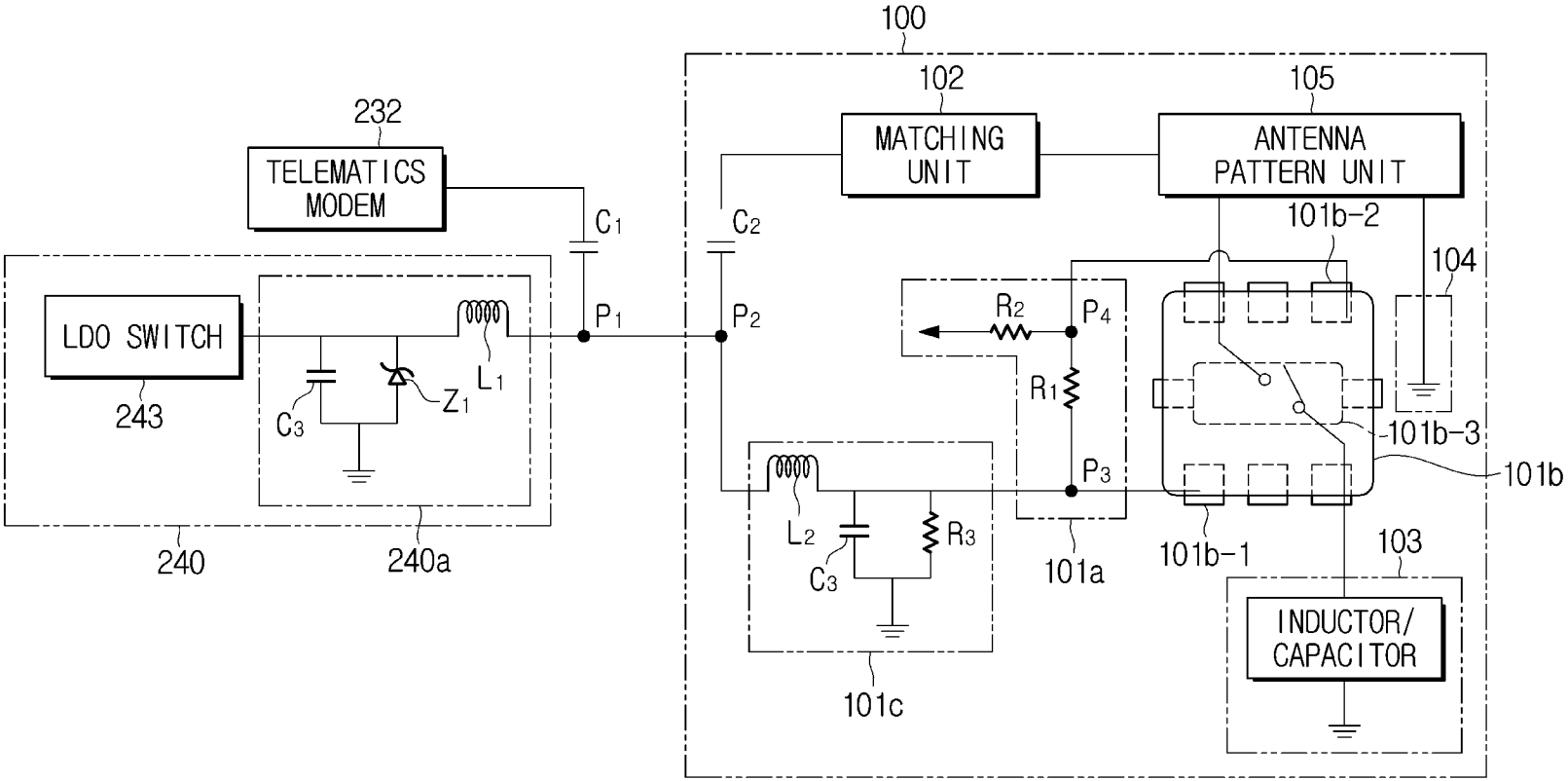
FIG. 6 is a view illustrating a tunable switch unit of an antenna apparatus in accordance with embodiments of the present disclosure.
Figure 7:
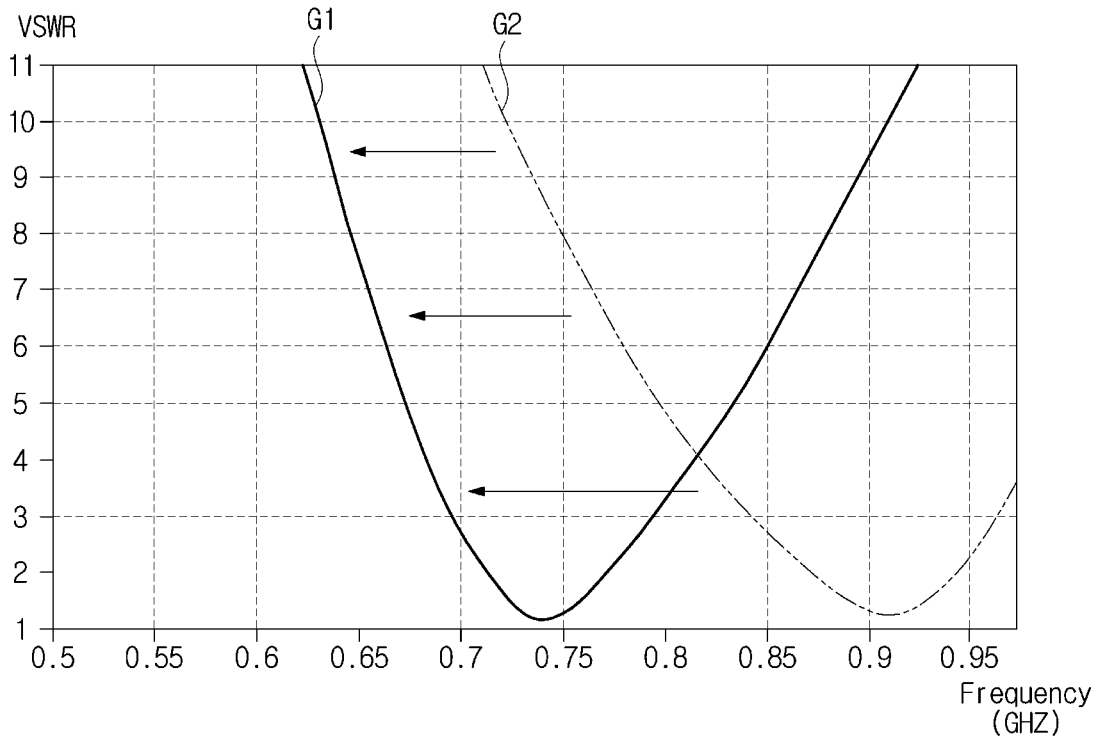
FIG. 7 is a view illustrating a movement of RF signal band of an antenna apparatus in accordance with embodiments of the present disclosure.

FIG. 6 is a view detailedly illustrating a tunable switch unit of an antenna apparatus in accordance with embodiments of the present disclosure. FIG. 7 is a view illustrating a movement of RF signal band of an antenna apparatus in accordance with embodiments of the present disclosure.

With reference to FIGS. 6 and 7, a configuration and an operation of the tunable switch unit of the antenna apparatus and a movement of RF signal band of the antenna apparatus will be described. However, a description of the same part as shown in the above will be omitted.

The tunable switch unit 101 may include the power distributor 101*a*, the controller 101*b* and a power supply stabilization circuit 101*c*.

The power distributor 101*a* may include at least two resistances. Referring to FIG. 6, the power distributor 101*a* may include a first resistance (R1) and a second resistance (R2).

The power distributor 101*a* may distribute the power supplied from the power supplier 240 to the controller 101*b*. For example, when 3 volts is supplied from the power supplier 240, 3 volts may be applied to P3. 3 volts applied may be distributed to the first resistance (R1) and the second resistance (R2). In this case, the distribution may be performed according to the voltage distribution law. When it is assumed that the first resistance (R1) is 1 kΩ and the second resistance (R2) is 3 kΩ, ¾*3 volts may be applied to P4. The voltage applied to a low point of P4 may be applied to a connection control terminal unit 101*b*-2 that is electrically connected. Referring to FIG. 6, the controller 101*b* may include a VDD power applicator 101*b*-1; the connection control terminal unit 101*b*-2; and a control switch unit 101*b*-3.

The VDD power applicator 101*b*-1 may receive 3 volts from the power supplier 240. When 3 volts is applied to the VDD power applicator 101*b*-1, the power may be distributed by the power distributor 101*a*. As mentioned above, ¾*3 volts that is distributed by the power distributor 101*a* may be applied to the connection control terminal unit 101*b*-2 of the controller 101*b*.

When ¾*3 volts that is distributed to the connection control terminal 101*b*-2 of the controller 101*b* is applied, a control command may be transmitted to the control switch unit 101*b*-3 of the controller 101*b* so that the antenna pattern unit 105 and the first ground unit 103 are connected to each other.

When receiving the control command for the connection between the antenna pattern unit 105 and the first ground unit 103 from the connection control terminal 101*b*-2, the control switch unit 101*b*-3 may allow the antenna pattern unit 105 and the first ground unit 103 to be connected to each other. When the antenna pattern unit 105 and the first ground unit 103 are connected to each other, the electrical length of the antenna apparatus 100 may be lengthened, and when the electrical length of the antenna apparatus 100 is lengthened, the antenna apparatus 100 may transmit and receive a RF signal band having a low frequency. Accordingly, the RF signal band may be moved from a RF signal band having a high resonant frequency (G2 of FIG. 7) to a RF signal band having a low resonant frequency (G1 of FIG. 7), as illustrated in FIG. 7.

In contrast, when the power is not supplied to the tunable switch unit 101 from the power supplier 240 and thus the power is not applied to the VDD power applicator 101*b*-1, the power may not also be distributed to the power distributor 101*a*. Therefore, in this case, since the power is not applied to the connection control terminal unit 101*b*-2, the antenna pattern unit 105 and the first ground unit 103 may be not connected to each other. Accordingly, the electrical length of the antenna apparatus 100 may be not changed and thus the RF signal band of the antenna apparatus 100 may be not moved (i.e., G2 of FIG. 7 is maintained).

The second ground unit 104 connected to the antenna pattern unit 105 may be different from the first ground unit 103, and the second ground unit 104 may be connected to the antenna pattern unit 105 without the tunable switch unit 101, unlike the case of the first ground unit 103. Therefore, when the power is not applied to the tunable switch unit 101 and thus the first ground unit 103 is not connected to the antenna pattern unit 105, the second ground unit 104 may act as a ground point and the electrical length of the antenna may be changed in comparison with when the first ground unit 103 is connected.

FIG. 7 illustrates a graph indicating that a RF signal band is moved according to the change in the electrical length of the antenna.

When the power is supplied from the power supplier 240 and thus the power is applied to the tunable switch unit 101, the antenna pattern unit 105 and the first ground unit 103 may be connected to each other, as mentioned above, so that the electrical length of the antenna apparatus 100 may be lengthened. Therefore, the antenna apparatus 100 may transmit and receive a RF signal band having a low frequency, and the RF signal transmission and reception band of the antenna apparatus 100 may be moved to have a low resonant frequency (G1 of FIG. 7). That is, G1 may represent a case in which the tunable switch unit 101 is operated by receiving the power and show a RF signal band having a resonant frequency of 730 MHz.

In contrast, when the power is not supplied from the power supplier 240 and thus the power is not applied to the tunable switch unit 101. Therefore, the antenna pattern unit 105 and the first ground unit 103 may be not connected to each other, and it may represent that the electrical length of the antenna apparatus 100 is shortened. That is, it may represent a case in which the tunable switch unit 101 is not operated since the power is not applied from the power supplier 240. In this case, it may be assumed that a ground point is the second ground point 104, as illustrated in FIG. 6. The antenna apparatus 100 may have a RF signal band having a high frequency, wherein a resonant frequency is 920 MHz (G2 of FIG. 7).

The description of the above described FIG. 7 is a graph illustrating that a RF signal band of the antenna apparatus 100 is moved according the operation of the tunable switch unit 101, but is not limited thereto.

The power supply stabilization circuit 101*c* may include a third resistance (R3), a fourth capacitor (C4) and a second inductor (L2). The power supply stabilization circuit 101*c* may allow the power supplied from the power supplier 240 to be stably applied to the controller 101*b*.

Figure 8:
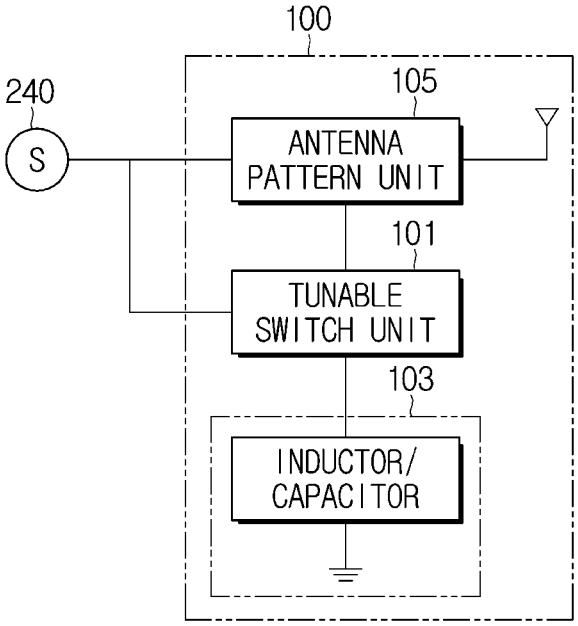
FIG. 8 is a view illustrating a case an antenna apparatus is changed from a dipole type antenna to a planar inverted F-antenna in accordance with embodiments of the present disclosure.
Figure 9:
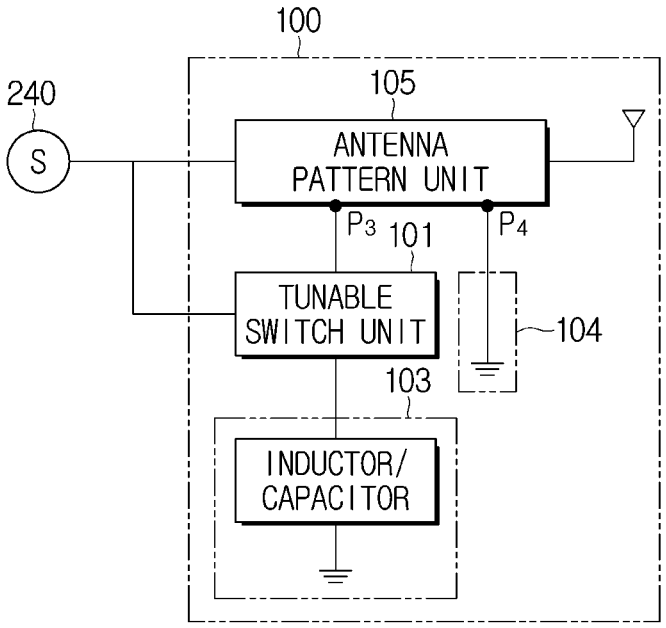
FIG. 9 is a view illustrating a case an antenna apparatus is changed from a planar inverted F-antenna to a planar inverted F-antenna having different RF signal band antenna in accordance with embodiments of the present disclosure.

FIG. 8 is a view illustrating a case an antenna apparatus is changed from a dipole type antenna to a planar inverted F-antenna in accordance with embodiments of the present disclosure. FIG. 9 is a view illustrating a case an antenna apparatus is changed from a planar inverted F-antenna to a planar inverted F-antenna having different RF signal band antenna in accordance with embodiments of the present disclosure. However, a description of the same part as shown in the above will be omitted.

Referring first to FIG. 8, the type of the antenna apparatus 100 may be changed according to whether the power is supplied to the tunable switch unit 101 of the power supplier 240.

When the power is not supplied to the tunable switch unit 101 of the power supplier 240, the antenna apparatus 100 may be in a state in which the first ground unit 103 and the antenna pattern unit 105 are not connected to each other, and the antenna apparatus 100 may act as a dipole type antenna.

Alternatively, when the power is supplied to the tunable switch unit 101 from the power supplier 240 and thus the antenna pattern unit 105 and the first ground unit 103 are connected to each other as mentioned above, the antenna apparatus 100 may act as a planar inverted F-antenna.

Referring next to FIG. 9, although the power is not supplied to the tunable switch unit 101 from the power supplier 240 and thus the antenna pattern unit 105 and the first ground unit 103 are not connected to each other, P4 may be connected to the second ground unit 104 and thus the antenna apparatus 100 may act as a planar inverted F-antenna.

In addition, when the power is supplied to the tunable switch unit 101 from the power supplier 240, the antenna pattern unit 105 and the first ground unit 103 may be connected to each other, as mentioned above, and thus the antenna apparatus 100 may act as a planar inverted F-antenna. In this case, a point grounded to the antenna pattern unit 105 is P3 and thus the antenna apparatus 100 may have a different RF signal band that is different from a case of an antenna apparatus 100 in which P4 is a grounded point since the power is not applied to the tunable switch unit 101.

Figure 10:
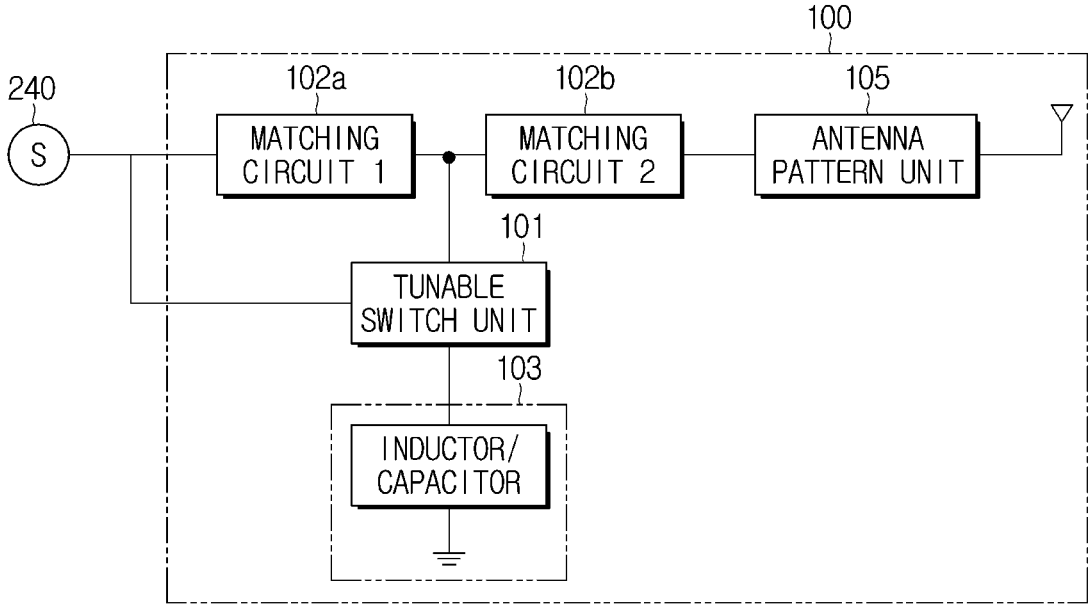
FIG. 10 is a view illustrating another antenna in accordance with embodiments of the present disclosure.

FIG. 10 is a view illustrating another antenna in accordance with embodiments of the present disclosure.

In another example of the antenna apparatus 100, the antenna apparatus 100 may be capable of moving a RF signal band by simple changing impedance matching by connecting the tunable switch unit 101 to between an impedance matching circuit 102*a* and an impedance matching circuit 102*b* formed by a variable inductor and a variable capacitor. As illustrated in FIGS. 8 to 10, the tunable switch unit 101 may be connected to the antenna apparatus 100 in the various types and move a RF signal band of the antenna apparatus 100 according to whether the power is applied. Therefore, the antenna apparatus 100 may allow the tunable switch unit 101 to be activated or inactivated so as to move a RF signal band according to the need of a variety of bands of RF signal of the antenna apparatus 100.

Figure 11:
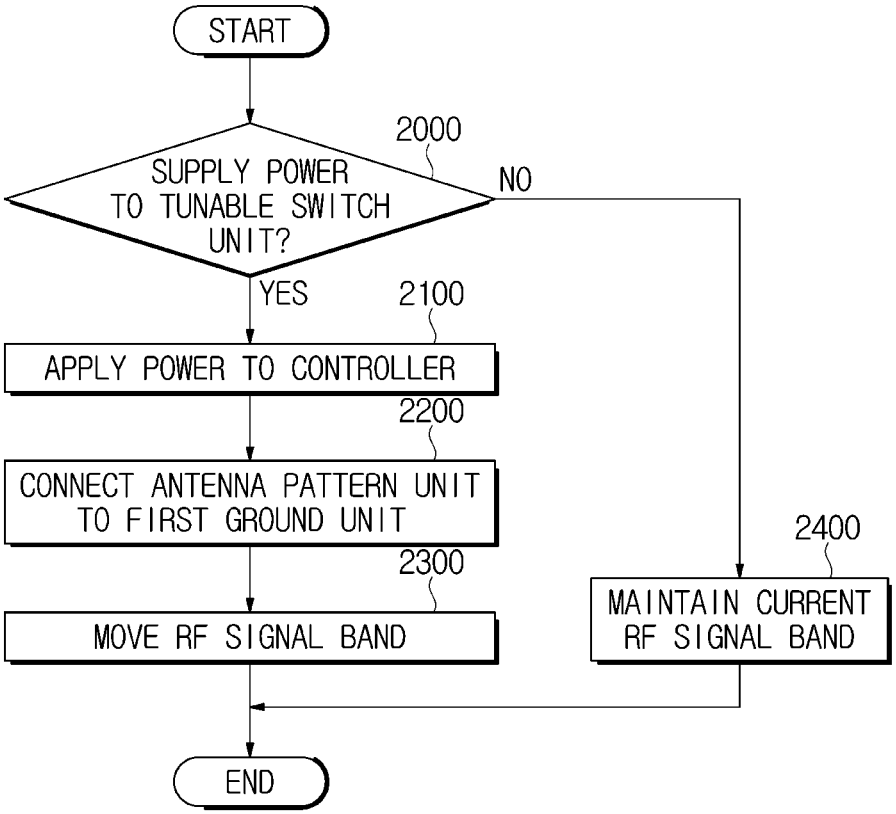
FIG. 11 is a view illustrating a method for controlling an antenna apparatus in accordance with embodiments of the present disclosure.

FIG. 11 is a view illustrating a method for controlling an antenna apparatus in accordance with embodiments of the present disclosure.

The antenna apparatus 100 may move a RF signal band of the antenna apparatus 100 by using the tunable switch unit 101 to transmit and receive a RF signal of the antenna apparatus 100 in a certain band among the variety RF signal bands as needed. In other words, the antenna apparatus 100 may move a resonant frequency of the antenna apparatus 100. Firstly, the power supplier 240 may supply the power to the tunable switch unit 101 in response to the power supply command of the controller 220 or may stop supplying the power to the tunable switch unit 101 in response to the power stop command of the controller 220 (2000).

When the power is supplied to the tunable switch unit 101 (YES of 2000), the power may be distributed by the power distributor 101*a* and then applied to the controller 101*b*, as illustrated in FIG. 6 (2100). The controller 101*b* may electrically connect the antenna pattern unit 105 to the first ground unit 103 (2200). In this case, a ground point of the antenna apparatus 100 may be changed and thus the electrical length of the antenna apparatus 100 may be lengthened. Therefore, a RF signal band of the antenna apparatus 100 may be moved from G2 to G1 to have a low resonant frequency, as illustrated in FIG. 7 (2300).

When the power is not supplied to the tunable switch unit 101 (NO of 2000), the power may be not applied to the controller 101*b*, as illustrated in FIG. 6. Therefore, the antenna pattern unit 105 and the first ground unit 103 may be maintained to be disconnected from each other and thus the current RF signal band may be maintained (2400).

Hereinbefore, the antenna apparatus having a wide RF signal band by moving a RF signal band by using a tunable switch unit, the method for controlling the antenna apparatus, and the vehicle having the antenna apparatus are described As is apparent from the above description, according to the antenna apparatus, method for controlling the antenna apparatus and vehicle having the antenna apparatus described herein, it may be possible to perform a communication in a wide RF signal band through a single antenna by using a tunable switch. In addition, it may be possible to move a RF signal band by controlling a tunable switch by a single feeder cable without adding an additional cable configured to supply the power to a controller of a tunable switch.

Although embodiments of the present disclosure have been shown and described, it would be appreciated by those skilled in the art that changes may be made in these embodiments without departing from the principles and spirit of the disclosure, the scope of which is defined in the claims and their equivalents. For example, when the above-mentioned techniques is executed in a different order from the above-mentioned method, and/or the above-mentioned components such as system, structure, device and circuit is coupled or combined in a manner different from the above-mentioned method or is replaced or substituted by other components or equivalents, the similar result may be achieved.

DESCRIPTION OF SYMBOLS

1: vehicle
100: antenna apparatus
101: tunable switch unit
102: controller
240: power supplier
241: power supply switch
242: DC/DC converter
243: LDO switch

What is claimed is:

1. An antenna apparatus comprising:

an antenna pattern unit receiving a radio frequency (RF) signal;

a first ground unit; and a tunable switch unit electrically connecting the first ground unit to the antenna pattern unit and moving a RF signal band of an antenna when power is applied to the antenna apparatus from a power supplier, wherein the tunable switch unit includes a power distributor provided with at least two resistances, and the power distributor distributes the power applied to the antenna apparatus from the power supplier corresponding to a resistance of the at least two resistances, wherein the tunable switch unit further includes a power supply stabilization circuit which is configured with a resistance, an inductor, and a capacitor, and the power supply stabilization circuit allows power supplied from the power supplier to be stably applied to a controller, and wherein the tunable switch unit further includes a controller controlling the first ground unit and the antenna pattern unit to be connected to each other or disconnected from each other according to whether the power is applied to the antenna apparatus from the power supplier.

2. The antenna apparatus of claim 1, wherein the controller controls the first ground unit and the antenna pattern unit to be connected to each other when the power is applied to the antenna apparatus from the power supplier and the power is distributed via the power distributor.

3. The antenna apparatus of claim 1, wherein the controller controls the first ground unit and the antenna pattern unit to be disconnected from each other when the power is not applied to the antenna apparatus from the power supplier and the power is not distributed via the power distributor.

4. The antenna apparatus of claim 1, wherein the first ground unit includes at least one of a variable inductor and a variable capacitor.

5. The antenna apparatus of claim 1, wherein the power applied to the antenna apparatus from the power supplier is 3 volts or a predetermined voltage.

6. The antenna apparatus of claim 1, further comprising:
a matching unit matching an impedance of the antenna.

7. The antenna apparatus of claim 1, further comprising:
a second ground unit different from the first ground unit, wherein the second ground unit is connected to the antenna pattern unit.

8. A vehicle comprising:
a power supplier; and
an antenna apparatus including an antenna pattern unit receiving a radio frequency (RF) signal, a first ground unit, and a tunable switch unit electrically connecting the first ground unit to the antenna pattern unit and moving a RF signal band of an antenna when power is applied to the antenna apparatus from the power supplier,
wherein the tunable switch unit includes a power distributor provided with at least two resistances, and the power distributor distributes the power applied to the antenna apparatus from the power supplier corresponding to a resistance of the at least two resistances,
wherein the tunable switch unit further includes a power supply stabilization circuit which is configured with a resistance, an inductor, and a capacitor, the power supply stabilization circuit allows power supplied from the power supplier to be stably applied to a controller, and
wherein the tunable switch unit includes a controller controlling the first ground unit and the antenna pattern unit to be connected to each other or disconnected from each other according to whether the power is applied to the antenna apparatus from the power supplier.

9. The vehicle of claim 8, wherein the controller controls the first ground unit and the antenna pattern unit to be connected to each other when the power is applied to the antenna apparatus from the power supplier and the power is distributed via the power distributor.

10. The vehicle of claim 8, wherein the controller controls the first ground unit and the antenna pattern unit to be disconnected from each other when the power is not applied to the antenna apparatus from the power supplier and the power is not distributed via the power distributor.

11. The vehicle of claim 8, wherein the first ground unit includes at least one of a variable inductor and a variable capacitor.

12. The vehicle of claim 8, wherein the power applied to the antenna apparatus from the power supplier is 3 volts or a predetermined voltage.

13. The vehicle of claim 8, further comprising:
a feeder cable connecting the antenna apparatus to the power supplier.

* * * * *